US010551005B2

(12) United States Patent
Ptaszek

(10) Patent No.: US 10,551,005 B2
(45) Date of Patent: Feb. 4, 2020

(54) DOUBLE WALLED INFLATABLE STORAGE STRUCTURE

(71) Applicant: Waldemar Ptaszek, Hingham, MA (US)

(72) Inventor: Waldemar Ptaszek, Hingham, MA (US)

( * ) Notice: Subject to any disclaimer, the term of this patent is extended or adjusted under 35 U.S.C. 154(b) by 0 days.

(21) Appl. No.: 15/983,414

(22) Filed: May 18, 2018

(65) Prior Publication Data

US 2019/0072236 A1 Mar. 7, 2019

Related U.S. Application Data

(60) Provisional application No. 62/554,782, filed on Sep. 6, 2017.

(51) Int. Cl.

| | |
|---|---|
| ***F17C 13/08*** | (2006.01) |
| ***F17C 13/02*** | (2006.01) |
| ***F17C 5/00*** | (2006.01) |

(52) U.S. Cl.

CPC ..... *F17C 13/081* (2013.01); *F17C 5/00* (2013.01); *F17C 13/025* (2013.01); *F17C 2201/052* (2013.01); *F17C 2203/0685* (2013.01); *F17C 2205/0107* (2013.01); *F17C 2221/013* (2013.01); *F17C 2227/0135* (2013.01)

(58) Field of Classification Search

CPC ..... F17B 1/26; F17C 13/081; F17C 13/025; F17C 5/00; F17C 2203/0685; F17C 2227/0135; F17C 2205/0107; F17C 2201/052; F17C 2221/013

USPC ..... 52/2.11, 2.19; 220/720, 560.08

See application file for complete search history.

(56) References Cited

U.S. PATENT DOCUMENTS

| | | | | |
|---|---|---|---|---|
| 2,335,300 | A | 11/1943 | Nefi | |
| 2,411,316 | A | 11/1946 | Capita | |
| 2,636,457 | A | 4/1953 | Finlay et al. | |
| 2,850,026 | A | 9/1958 | Leatherman | |
| 2,921,592 | A | 1/1960 | Mackey | |
| 3,307,301 | A | 3/1967 | Jacobsohn et al. | |
| 3,389,510 | A * | 6/1968 | Stock | E04H 15/22 47/17 |

(Continued)

FOREIGN PATENT DOCUMENTS

| | | | |
|---|---|---|---|
| EP | 0199592 | 10/1986 | |
| GB | 1046632 | 10/1966 | |
| JP | 11132397 A * | 5/1999 | F17B 1/26 |

OTHER PUBLICATIONS

Walker Process Equipment, Technical Information Sheet 6258.5a, Division of McNish Corporation, pp. 1-12, date not available.

*Primary Examiner* — Brent W Herring

(74) *Attorney, Agent, or Firm* — Pearl Cohen Zedek Latzer Baratz LLP

(57) ABSTRACT

An inflatable structure for gas storage includes an inner bladder containing a gas for storage and an outer wall spaced from the inner bladder. An intermediate space between the bladder and the outer wall is pressurized with a gas (such as air) other than the storage gas so that the structure is protected from environmental conditions such as wind and snow loading. The bladder and outer wall may be flexible fabric membranes and may be provided with lightweight support frames. The structures may be combined in a network of like structures for large scale storage.

8 Claims, 3 Drawing Sheets

(56) References Cited

U.S. PATENT DOCUMENTS 3,508,677 A * 4/1970 Laibson ..... B29C 53/602 220/590
4,902,304 A * 2/1990 Hallen ..... F17B 1/12 220/560.08
5,579,609 A * 12/1996 Sallee ..... B64G 9/00 156/156
5,676,180 A * 10/1997 Teel ..... F17C 5/06 137/267
5,908,141 A * 6/1999 Teel ..... F17C 5/06 141/18
6,360,490 B1 * 3/2002 Cotriss ..... B08B 15/02 52/138
6,547,189 B1 * 4/2003 Raboin ..... B64G 1/12 244/158.3
7,013,607 B1 3/2006 South
8,302,603 B1 * 11/2012 Weber ..... A62B 7/02 128/204.18
8,522,486 B2 * 9/2013 Dagher ..... B29C 33/505 52/2.15
8,770,219 B2 * 7/2014 Martens ..... C12M 21/04 137/208
8,863,571 B2 * 10/2014 Spedini ..... F17B 1/26 73/149
8,935,888 B2 * 1/2015 Dagher ..... B29C 33/505 52/2.15
9,366,050 B1 6/2016 Ptaszek
2002/0083653 A1 * 7/2002 Hilbert ..... E04H 1/1277 52/2.17
2007/0215752 A1 9/2007 Steinkerchner et al.
2011/0011008 A1 * 1/2011 Dagher ..... B29C 33/505 52/2.15
2012/0067117 A1 * 3/2012 Spedini ..... F17B 1/26 73/149
2014/0069024 A1 * 3/2014 Dagher ..... B29C 33/505 52/2.15

* cited by examiner

DOUBLE WALLED INFLATABLE STORAGE STRUCTURE

This application claims the benefit of U.S. Provisional Application No. 62/554,782, filed Sep. 6, 2017, which is incorporated by reference.

BACKGROUND OF THE INVENTION

Field of the Invention

The invention is in the field of inflatable structures and is specifically directed to an inflatable structure for storing gas, such as carbon dioxide.

Description of the Related Art

Inflatable structures are disclosed, for example, in GB 1,046,632 to Lobelle; U.S. Pat. No. 2,850,026 to Leatherman; U.S. Pat. No. 3,307,301 to Jacobsohn; EP 0199592 to Plant; and U.S. Pat. No. 2,921,592 to Mackey; US 2007/0215752 to Steinkerchner; U.S. Pat. No. 7,013,607 to South; U.S. Pat. No. 2,636,457 to Finlay, and U.S. Pat. No. 9,366,050 to Ptaszek (the inventor herein), all of which are incorporated by reference.

It would be a desirable advance in the art to provide an inflatable structure that can provide for storage of large volumes of gas in different environmental conditions.

BRIEF DESCRIPTION OF THE DRAWINGS

The subject matter regarded as the invention is particularly pointed out and distinctly claimed in the concluding portion of this specification. The invention, however, both as to organization and method of operation, together with objects, features, and advantages thereof, may best be understood by reference to the following detailed descriptions when read with the accompanying drawings in which:

Figure 1:
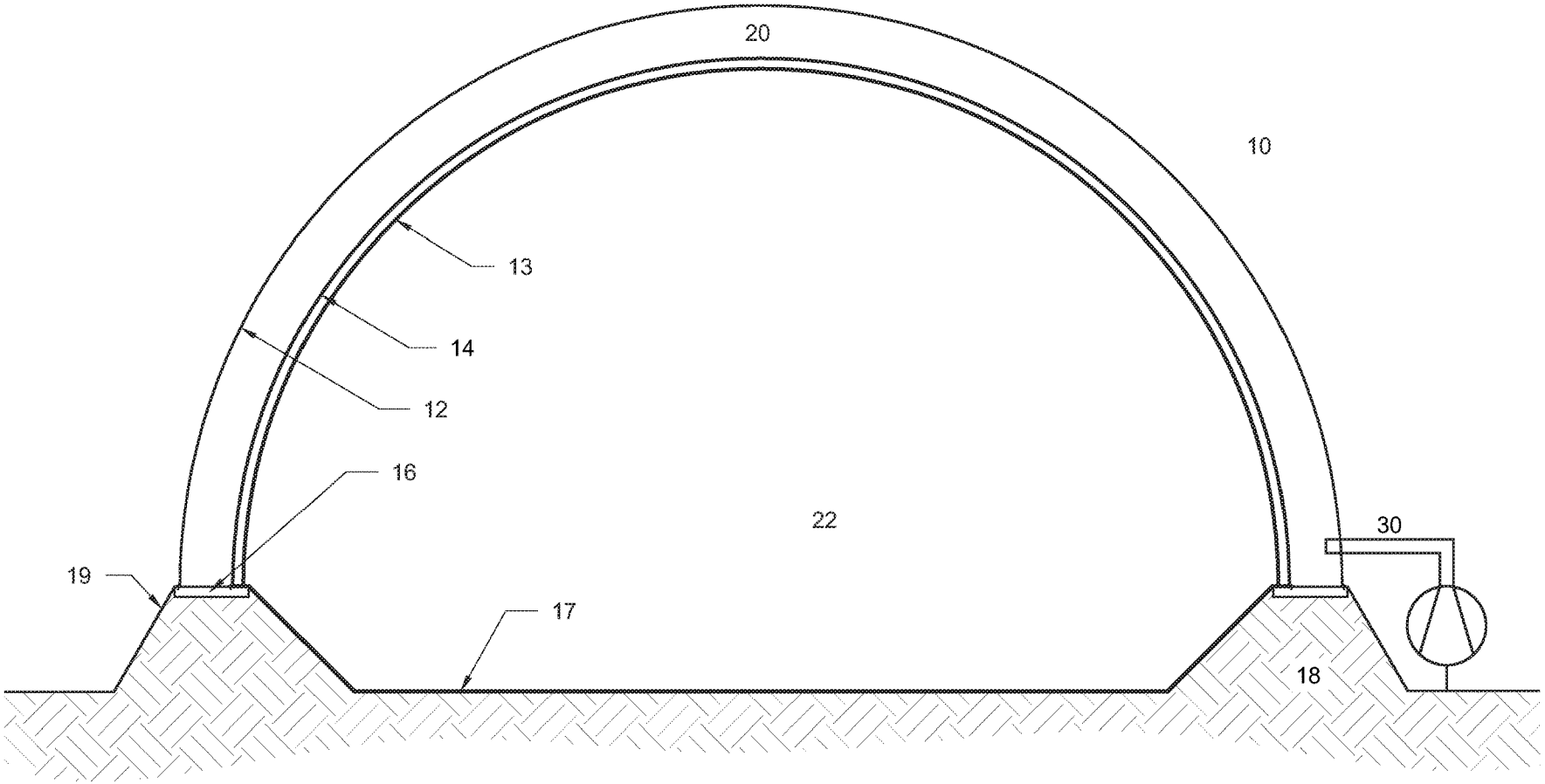
FIG. 1 depicts a cross sectional view of a storage structure according to an embodiment of the invention comprising an earth berm and ground liner.
Figure 2A:
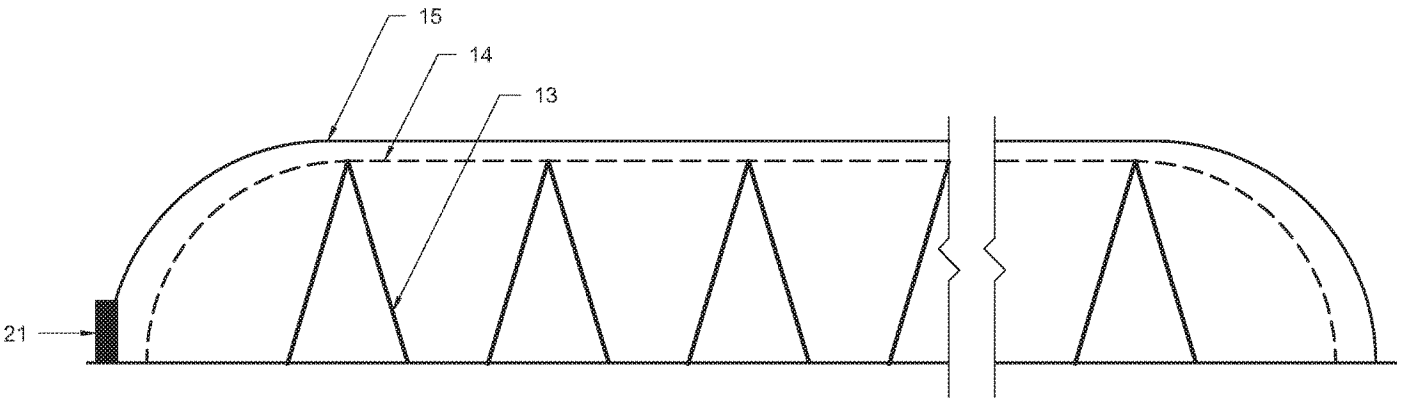
FIGS. 2A and 2B depict plan, side elevation and cross-sectional views of a storage structure according to an embodiment of the invention.
Figure 2B:
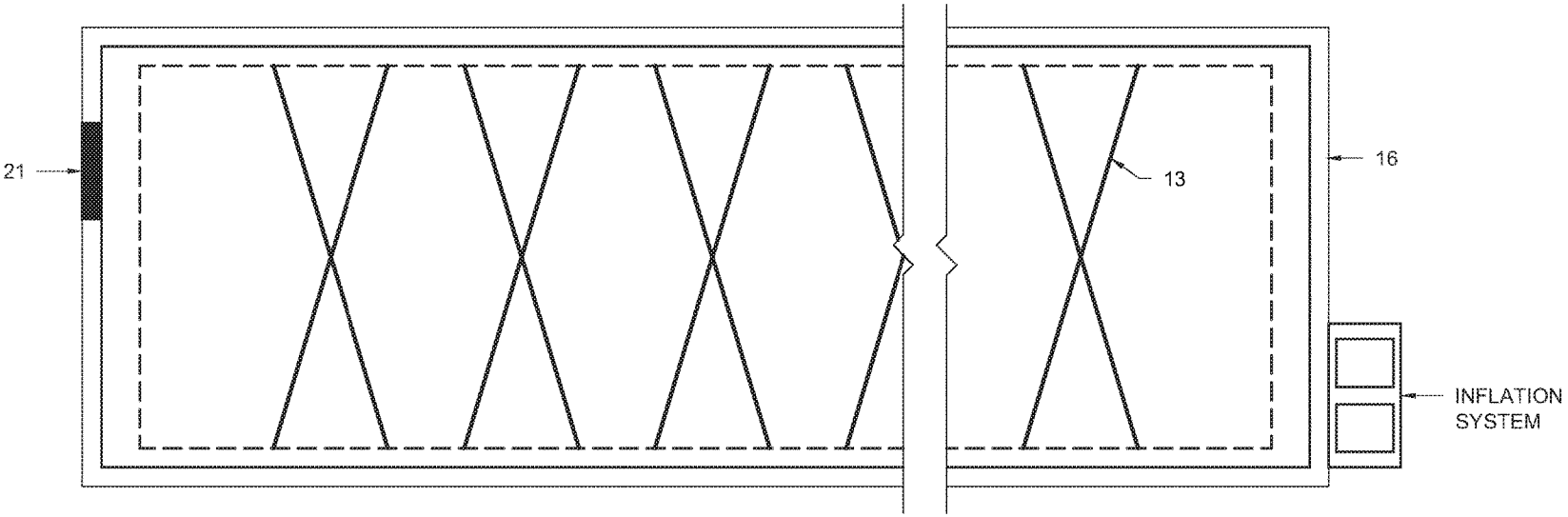

The Figures are schematic and not drawn to scale.

SUMMARY OF THE INVENTION

An object of the present invention is to provide a cost-effective temporary or long-term portable or permanent solution for gas storage adapted to a variety of environmental conditions, especially for gases that may be produced and stored in high volume and which are not extremely toxic or corrosive, including but not limited to, $CO_2$.

Thus, in one aspect, the invention is an inflatable structure for gas storage, comprising: an inflatable bladder containing gas for storage ("storage gas") made of flexible material impermeable to the storage gas and an outer inflatable wall, separated from the inflatable bladder by a pressurized intermediate space containing a gas different from the storage gas.

Generally, one or more blowers may be operatively connected to the intermediate space to pressurize the intermediate space with air, or other gas, and an additional blower or blowers may be provided with conduits to convey the storage gas in and out of the bladder. Sensors and controls are provided to manage the pressure of the storage gas in the bladder and to manage the pressurization of the intermediate space.

In embodiments, the bladder in each storage structure is adapted to contain 2 million to 200 million cubic feet of gas, such as carbon dioxide.

In embodiments, a storage system includes plurality of similar or identical inflatable structures, interconnected by appropriate conduits to accommodate larger scale gas storage.

DETAILED DESCRIPTION OF THE PREFERRED EMBODIMENTS

In the following detailed description, numerous specific details are set forth in order to provide a thorough understanding of the invention. However, it will be understood by those of ordinary skill in the art that the present invention may be practiced without these specific details. In other instances, well-known methods, procedures, and/or components have not been described in detail so as not to obscure the present invention.

An inflatable fabric structure for gas storage according to the invention is designed for a temporary, long-term, portable and/or permanent storage of large quantities of gas such as $CO_2$. This system is cost-effective, flexible as to size and capacity, and can be easily installed in any climate.

In the embodiments shown in the Figures, storage system 10 comprises a double fabric air wall structure. The outer structure or wall 12 provides protection from the elements and the inner structure or wall 14 (also referred to as a "bladder") is used to contain a gas for storage (the "storage gas"). The outer wall may be a fabric membrane supported by a frame or may be any type of rigid conventional construction. The outer structure may be independently pressurized, such as with air, as needed, to withstand wind and snow loading in a geographical area of installation. Likewise, the materials for the outer wall may be selected as needed to accommodate higher pressure level and/or more stringent industry standards. For example, intermediate space 20 between bladder 14 and outer wall 12 may be pressurized to a higher pressure depending on environmental factors, for example to accommodate higher winds (such as 80 mph, 120 mph, 150 mph) and snow loading. Air supported structure design and operation should meet or exceed minimum standards as per American Society of Civil Engineers ASCE17-96. Pressure in space 20 to meet wind design pressure as per ASCE17-96. Pressure may vary between 1" of water column to 3" subject to wind velocity design.

Pressure may be provided to space 20 by a variable speed blower 30 with automated controls for capacity and pressure. Blower system capacity may be selected to accommodate a variable size of the bladder, as well as to replace a total volume of air at the designed pressure within 2 hrs. Inflation system should consist of primary and a secondary blower(s). The secondary blower(s) needs to have same capacity as primary, as well as automatic pressure sensor switch to activate the secondary blower(s) in case of pressure drop. Electric blowers require an independent power generator.

Inner bladder storage space 22 is independent of the pressurized space 20 between the two fabric layers and will be only pressurized with the gas pumped in for storage. The bladder may be supported by a relatively lightweight frame 13 of bent aluminum or steel, to support the bladder fabric weight when the bladder is not inflated with $CO_2$ or may be unsupported and able to collapse on the ground when gas is pumped out.

Space 20 between the two walls (which in certain non-limiting embodiments may be in a range of about 4-6 feet is pressurized to provide stability under loads from wind and snow as it may be required by a local building code in the area of installation.

The material of the outer wall is not particularly limited and may be selected from among known materials to form a substantially impermeable membrane. The particular materials used may be selected based on the expected environmental conditions, expected inflation pressure level as well as industry standards. Typically, PVC coated polyester fabric with tensile and tear strength to meet ASCE17-96 standards for stress, based on pressure required to support the wind load inside space 20.

The fabric wall of the inner bladder should also be polyester reinforced PVC coated fabric capable to withstand a stress resulting from minimum of 1"-2" water column pressure inside the bladder, (as per ASCE17-96 STD) substantially impermeable to the storage gas and may be supported by a light steel frame to prevent the inner bladder from totally collapsing when gas is pumped out. However, in embodiments, the steel frame is not included, and the bladder may be designed to collapse on the ground when empty, at which point the "intermediate" space 20 is substantially the entire inside space.

The system is equipped with an automatic inflation system with a back-up blowers and pressure balance dampers 21 to maintain proper pressure between the fabric layers of the outer structure and inner bladder at all times. When the bladder is empty, and storage gas is being pumped in, the bladder will expand and increase the pressure in space 20 between the bladder and outer membrane, at that point pressure balance damper 21 opens to allow a designed pressure to be maintained in space 20. For example, the inner bladder may be inflated with gas to a slightly lower or higher pressure than the space between outer and inner bladder, which may be pressurized with air, for example. The pressure in the space between the bladder and the outer structure is preferably higher than the pressure in the bladder to minimize gas leakage and facilitate pumping gas out of the bladder. Providing the intermediate space with a pressure higher than the bladder by about ½ inch to 1" of water column is generally sufficient for this purpose.

In embodiments, the outer structure 12 may be a supported fabric structure. Both the inner bladder and the outer structure may be a half cylinder shape.

The inflatable structure according to the invention is adapted to be installed on the ground with minimal foundation requirements. A concrete pad 16 may be provided for ballast at the perimeter of the structure to meet uplift load requirements based on wind design for the geographical location and ASCE17-96 requirement. Bladder capacity in a storage unit may have a volume in a range of 2-200 million cubic feet. To increase the storage volume capacity, a trench can be excavated in the ground inside the bladder section. Soil treatment may be needed to prevent the gas from permeating the soil. A floor liner 17 may be used on the ground. The extra soil from excavating the inside of the structure can be used to create a perimeter berm 19, in effect dramatically increasing the volume inside the bladder for gas storage.

Example

In one example (not to be deemed as limiting the invention) storage capacity may be in the neighborhood of 68,000 $m^3$ (2,425,000 $ft^3$) of gas (for a single storage unit). This size may be appropriate for $CO_2$ storage at a power generation facility, for example. For this purpose, an outer structure may be in the form of a half-cylinder, with plan dimensions of approximately 110'×700' and a height of 55' in the center. The inner structure may have a floorplan of approximately 100'×680' and a height of 50' in the center. The storage volume capacity is approximately 68,600 $m^3$ (2,425,000 $ft^3$). If a storage site requires more total capacity than can be provided by a single 100'×680'×50' structure, then multiple structures may be interconnected with appropriate conduits and blowers or other equivalent gas transport apparatus.

The following steps may be followed to make and use a structure according to the invention for $CO_2$ storage at a given installation site:

1. A total volume of gas ($CO_2$) storage capacity is established for a given installation site. Many sites may require total $CO_2$ storage capacity of over 1,000,000 $m^3$ and up to 35,000,000 $ft^3$ of storage.

2. A size of individual structures (bladders) is determined (approx. 100'×700'×50' high) and multiplied by number of bladders to achieve the total volume of storage capacity. To maximize the storage capacity of gas, an earth berm may be created at the perimeter.

3. The gas handling blowers to pump the gas in and out are dedicated and sized to automatically control volume and pressure of the gas during in/out pumping, as well as maintaining designed pressure in the bladder. When multiple bladders are used at the same site, the automatic pumping in/out system to have pressure balance valves to automatically close and open based on each bladder reaching its design capacity. Pressure valve at each bladder blower will automatically shut the blower when set pressure is reached within the given bladder. The next available bladder valve can be open manually or automatically to continue fill-up or discharge.

Figure 3:
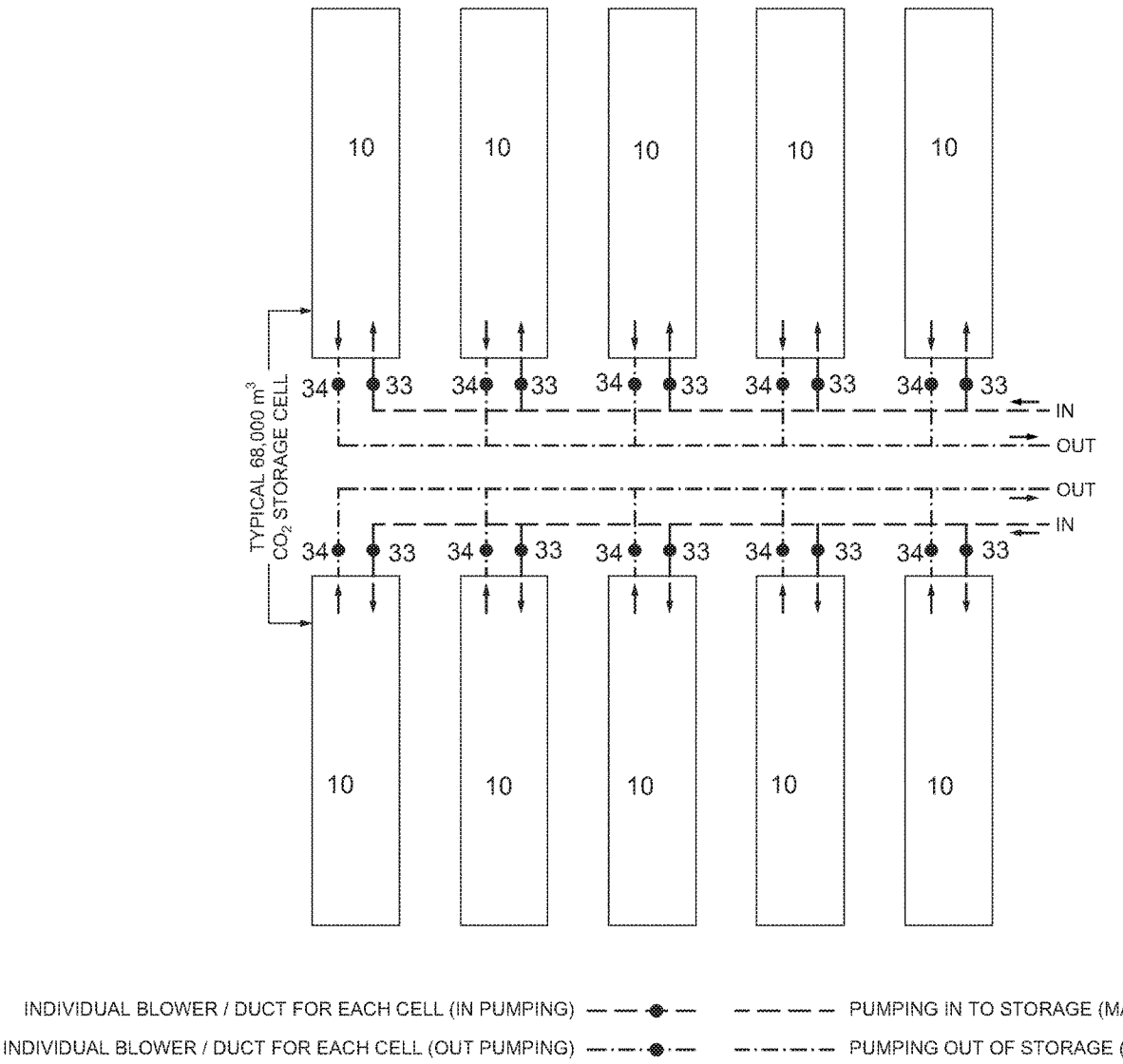
FIG. 3 schematically depicts an example of a multi-cell storage system using multiple storage structures interconnected by ductwork.

4. Individual structures are connected to a common duct work and a control system to maintain proper pressure/volume in each structure during pumping in or out of the gas ($CO_2$) into the bladders. (As shown in FIG. 3 for example).

5. Outer structure size and weather elements criteria may be established and designed based on geographical location of the installation. The outer structure should be (in many cases) approximately 10' wider and higher to allow approximately 5' clearance space between the outer membrane and the inner bladder when bladder inflated with gas ($CO_2$). If air supported structure used, the membrane envelope to be properly selected based on internal pressure required to support wind design. The outer fabric membrane can be translucent at the perimeter base to allow natural light with balance of the fabric to be opaque to minimize "green-house effect".

6. Outer structure installed and inflated (if air structure used) with dedicated inflation blowers and discharge dampers. The dampers may be pressure balanced to accommodate fluctuating volume/pressure inside the outer structure during pumping in or out of gas ($CO_2$) into or out of the bladder. The inflation blowers for the outer structure to automatically maintain pressure as required to accommodate the local wind load, and to be slightly higher than pressure in the bladder when filled. The higher pressure inside the outer structure will also minimize gas leakage from the bladder into the space between in bladder and the outer wall. Provide access doors for personnel and equipment into the structure as required.

7. The bladder may be installed inside the outer structure with minimum of 4' clearance between the outer structure wall and bladder when full of gas. Advantageously, the operator will seal a perimeter clamp-down connection with caulking to minimize gas leaking. The bladder can be installed over a light steel frame if bladder fabric is to be above the floor surface when empty.

In embodiments, multiple storage cells may be interconnected as in the multi cell installation depicted in FIG. 3, which incorporates three blower systems, including: a system of individual blower(s) 33 to fill the bladders of each storage unit; a system of blower(s) 34 for pumping storage gas (such as $CO_2$) out of the units; and blower(s) 30 for independently pressurizing the intermediate space(s).

Whenever a specific installation requires more storage capacity than one structure can provide, a plurality of structures may be combined and interconnected to provide required storage capacity. Each structure/cell may be independently filled and pressure controlled, however, for maximum safety control and ease of operation.

Standards referenced in this description refer to standards in effect on the date of filing of this application.

Numerical quantities identified herein are understood to be approximate. Where a numerical value is modified by the words "about" or "approximately" it is understood that a variation of +/−15% is contemplated without departing from the scope of the invention.

The exemplary embodiments shown and described are not to be deemed limiting of the invention which is defined by the appended claims. One of ordinary skill in the art would be expected to exploit variants within the scope of the present claims. Features and dependent claim limitations described and claimed in connection with one embodiment or independent claim may be combined with another embodiment and independent claim without departing from the scope of the invention.

What is claimed is:

1. A system for gas storage, comprising at least first and second inflatable structures for gas storage, the first and second inflatable structures each comprising:

an inflatable bladder having an internal volume containing storage gas and made of flexible material impermeable to the storage gas;

a frame supporting the flexible material substantially maintaining the internal volume when the bladder is emptied;

an outer inflatable wall, separated from the inflatable bladder by a pressurized intermediate space containing a gas different from the storage gas, said outer inflatable wall providing protection from environmental conditions;

at least one first blower adapted to transport a gas to the intermediate spaces of said first and second inflatable structures; and at least one second blower adapted to transport storage gas to the bladders of said first and second inflatable structures; and ductwork connecting the bladders of said first and second inflatable structures to a source of storage gas.

2. The system according to claim 1, further comprising a sensor and a controller responsive to pressure in the intermediate space of each structure and pressure in the bladder of each structure to maintain pressure in the intermediate space of each respective structure higher than the pressure in the bladder of each respective structure.

3. The system according to claim 1, wherein the bladder of each structure has an interior volume for storage in a range of 50,000-100,000 $m^3$.

4. The system according to claim 1, comprising a frame supporting the outer wall of each structure.

5. The system according to claim 1, wherein the outer wall of each structure is not supported by a frame when pressurized.

6. The system according to claim 1, wherein each structure is adapted to be installed on a dirt floor, and wherein the dirt floor is treated to be impermeable to storage gas.

7. The system according to claim 1, wherein each structure is adapted to be installed on the ground and further comprising an earth berm around at least a portion of each structure.

8. The system according to claim 1, comprising a gas-impermeable liner on a floor space of each structure.

* * * * *